US012276049B2

(12) United States Patent
Brielmann

(10) Patent No.: US 12,276,049 B2
(45) Date of Patent: Apr. 15, 2025

(54) SAFETY BELT WEBBING FOR A VEHICLE

(71) Applicant: BERGER GMBH & CO. HOLDING KG, Alfdorf (DE)

(72) Inventor: Roland Brielmann, Alfdorf (DE)

(73) Assignee: Berger GmbH & Co. Holding KG, Altdorf (DE)

( * ) Notice: Subject to any disclaimer, the term of this patent is extended or adjusted under 35 U.S.C. 154(b) by 0 days.

(21) Appl. No.: 18/250,658

(22) PCT Filed: Dec. 27, 2021

(86) PCT No.: PCT/EP2021/087680

§ 371 (c)(1),
(2) Date: Apr. 26, 2023

(87) PCT Pub. No.: WO2022/174968

PCT Pub. Date: Aug. 25, 2022

(65) Prior Publication Data

US 2023/0399775 A1 Dec. 14, 2023

(30) Foreign Application Priority Data

Feb. 19, 2021 (DE) ..... 10 2021 104 034.5

(51) Int. Cl.

| | |
|---|---|
| ***B60R 22/12*** | (2006.01) |
| ***D03D 1/00*** | (2006.01) |
| ***D03D 13/00*** | (2006.01) |

(52) U.S. Cl.
CPC ..... *D03D 1/0005* (2013.01); *D03D 13/004* (2013.01); *D10B 2505/122* (2013.01)

(58) Field of Classification Search
CPC ..... D03D 1/0005; D03D 13/004; D10B 2505/122
See application file for complete search history.

(56) References Cited

U.S. PATENT DOCUMENTS 5,188,884 A * 2/1993 Smith ..... D21F 1/0054 162/902
5,769,130 A * 6/1998 Brielmann ..... D03D 13/004 139/22

(Continued)

FOREIGN PATENT DOCUMENTS

| | | | |
|---|---|---|---|
| DE | 102012001632 | B3 | 2/2013 |
| DE | 102011084336 | B4 | 12/2013 |
| EP | 1373755 | B1 | 11/2004 |

*Primary Examiner* — Robert H Muromoto, Jr.
(74) *Attorney, Agent, or Firm* — Laurence A. Greenberg; Werner H. Stemer; Ralph E. Locher

(57) ABSTRACT

A safety belt webbing for a vehicle includes a woven fabric from mutually intersecting warp and weft threads. The woven fabric is at least partially configured in the weave repeat with at least 6, preferably at least 8 ends. The weave repeat per warp thread includes at least four, preferably six, intersection points with the weft threads. The intersection points are weave points resulting between the warp and the weft threads when the warp thread within the weave repeat alternates from a warp elevation to a warp depression, or vice versa. Within the weave repeat the largest warp float per warp thread is across two weft threads, and the maximum warp depression is below two weft threads. Within the weave repeat, per warp thread there is at least one warp elevation additionally to the warp float across a weft thread, and at least one warp depression below a weft thread.

12 Claims, 3 Drawing Sheets

(56) References Cited

U.S. PATENT DOCUMENTS

| | | | | |
|---|---|---|---|---|
| 6,918,411 | B2 * | 7/2005 | Berger | D03D 47/44 156/48 |
| 7,743,794 | B2 * | 6/2010 | Berger | D03D 1/0005 139/432 |
| 9,827,944 | B2 * | 11/2017 | Brielmann | D03D 1/0005 |
| 2012/0192988 | A1 * | 8/2012 | Welz | D03D 1/0005 139/383 R |
| 2014/0232165 | A1 * | 8/2014 | Brielmann | B60R 22/12 139/11 |
| 2017/0341621 | A1 * | 11/2017 | Helvoort | D03D 11/02 |

* cited by examiner

SAFETY BELT WEBBING FOR A VEHICLE

FIELD AND BACKGROUND OF THE INVENTION

The invention relates to a safety belt webbing for a vehicle, preferably a motorized vehicle. The latter may be a land craft, such as a motor vehicle, truck, bus or rail vehicle. In principle the term vehicle is also understood to mean a watercraft or an aircraft, such as an airplane.

In the vehicles mentioned, safety belt webbing is used for the production of safety belts. The latter are part of restraint systems for preventing impact injuries and occupants being ejected from the vehicle in the event of an accident. Such a restraint system typically has a tongue which is attached to the safety belt and by way of which said restraint system for fastening the occupant is able to be slotted into a belt buckle, and for unfastening is able to be released from the latter again. Moreover, the restraint system has a retractor and a deflector for deflecting the safety belt, and an end fitting.

Safety belt webbings are conventionally at least partially produced from woven fabrics, thus from mutually intersecting warp threads and weft threads. Weaves known from the prior art for such safety belt webbings include, for example, the even-sided simple twill, the warp twill or weft twill in alternation, and in comparatively rare cases the rib weave or plain weave.

Safety belt webbings which typically have a thickness of 1.2 mm or even more are established in the market. However, such a comparatively great thickness has a disadvantageous effect on the installation space of the retractor: the thicker the belt webbing, the larger the wound volume and the larger the installation space required by such a retractor. More recent developments, such as autonomous driving, require a further reduction in terms of the installation space and/or weight of the vehicle. If these requirements are to be met, the belt webbing inevitably has to be thinner. To this end, the quantity of material of the safety belt webbing per square centimeter has to be reduced.

Apart from the advantageous effects such as lower material and labor costs, the reduction in the material quantity does however also have several disadvantages.

The weave patterns known from the prior art are in most cases not suitable for thinner safety belt webbings. Moreover, a pure reduction in the thickness while simultaneously reducing the thread count and/or the yarn count leads to a loss in terms of mechanical properties such as breaking strength or stiffness. As a result of less material, the woven fabric loses stability. This also has a negative effect on the usage properties for the vehicle occupants, such as the fastening and wearing of the safety belt. In the case of a thinner safety belt, the winding up in the retractor may be affected negatively, the risk of twisting in the tongue is increased, rubbing due to extraction and retraction in the retractor and on the tongues and on the deflector can subject said safety belt to more stress. Finally, a thinner safety belt webbing may wear out earlier than a thicker safety belt webbing so that the service life of such a safety belt webbing is compromised as a result.

The invention thus relates to a generic safety belt webbing of a restraint system of a vehicle mentioned at the outset

SUMMARY OF THE INVENTION

Therefore, it is the object of the invention to specify a safety belt webbing for a vehicle which is thinner in comparison to the prior art and has substantially the same mechanical characteristics and usage properties as such a known safety belt webbing.

The object on which the invention is based is achieved by a safety belt webbing for a vehicle, according to the independent claim. Preferred embodiments of the invention are set forth in the dependent claims which may be selectively combined with one another.

A safety belt webbing for a vehicle comprises a woven fabric from mutually intersecting warp threads and weft threads, wherein the woven fabric is at least partially configured in such a manner that said woven fabric in the weave repeat is embodied with at least 6 ends, preferably 8 ends; wherein a) the weave repeat per warp thread comprises at least four, preferably six, intersection points with the weft threads, wherein the intersection points are those weave points that result between said warp thread and the weft threads when the warp thread within the weave repeat alternates from a warp elevation to a warp depression, or vice versa; and b) within the weave repeat the largest warp float per warp thread is across two weft threads, preferably exactly two weft threads (weft insertions) and the maximum warp depression is below two weft threads, preferably exactly below two weft threads (weft insertions); and c) within the weave repeat, per warp thread there is at least one warp elevation in addition to the warp float across a weft thread (weft insertion), and at least one warp depression below a weft thread (weft insertion).

Using such a woven fabric construction, a safety belt webbing according to the invention which is embodied so as to be significantly thinner in comparison to safety belt webbings (1.2 mm thick) known from the prior art can be specified. Said safety belt webbing according to the invention thus makes do with less material. Nevertheless, said safety belt webbing according to the invention has comparable mechanical characteristics and usage properties as a safety belt webbing known per se. In this way, said safety belt webbing according to the invention can be readily wound up in the retractor, the risk of twisting in the tongue is comparatively minor, and said safety belt webbing according to the invention is also more resistant to rubbing. In this way, a comparatively thinner safety belt webbing can be specified, the service life of the latter corresponding to that of thicker safety belt webbings. Using the woven fabric construction according to the invention, a safety belt webbing having a thickness of less than 1 mm, for example having a thickness of 0.95 mm, can be specified.

In the woven fabric construction, the weave repeat per warp thread can thus have (exactly) two floats with a warp elevation and two floats with a warp depression, and additionally one warp depression and one warp elevation. The term warp depression herein is synonymous with the term warp trough.

The term weave repeat in the weaving industry describes the repeated weave pattern (also referred to as the weave image) of a weave diagram. The schematic illustration of a weave is referred to as a weave diagram.

According to the invention, the weave repeat for an individual warp thread is frequently mentioned. In this instance, this refers to the weave sequence of the first warp thread of the weave repeat; the next warp threads follow as per the rules of the twill weave.

The term ends or "x ends" describes the number of warp threads and weft threads (or else weft insertions) in the weave repeat. A combined twill with 6 ends has 6 warp threads and 6 weft threads (weft insertions) in the weave repeat, while a combined twill with 8 ends in an analogous manner has 8 threads.

When warp floats are referred to, or when it is mentioned that a warp thread floats, this means that more than one weft thread lies between two successive weave points of the warp thread. In other words, a warp thread floats if the warp thread along the weave repeat has two successive warp depressions or warp elevations, for example. A warp depression in the weave image here means that the warp thread lies below the weft thread, while a warp elevation means that the warp thread lies above the weft thread.

In conventional automatic narrow fabric looms, the weft is inserted into the shed with the aid of a weft needle, which is why two weft threads per weft insertion are located in the woven fabric due to the method. A further weft may also be inserted by a second weft needle; in this case, there would be 4 weft threads in the woven fabric per weft insertion. In the warp elevations across the weft and the warp depressions, thus the depression of the warp thread, below the weft thread the respective meaning does not relate to the "weft threads" but to the weft insertion, or else simply the weft as one unit, this also being illustrated as such. This is also demonstrated in the numbering of the weft threads in the weave repeat. The weft thread is not a plurality of individual wefts that are cut off after insertion, but a continuous weft thread which as a result of the weft reversal, on the one hand, and as a result of a stitch course, conjointly with the selvedge warp threads, forms the webbing selvedge of the completed safety belt webbing.

According to the invention, when mention is made of weave points, this means the intersection between a warp thread and a weft thread, or of a weft insertion, in the weave image. The terms "weft threads" and "weft insertion" are therefore used synonymously in the present invention.

The definition "at least 6 ends" means that the woven fabric in the weave repeat has at least 6, preferably exactly six, and particularly preferably exactly 8 warp threads. The maximum number here may comprise 10 warp threads, thus have at least 10 ends.

The warp threads usually run in the longitudinal extent (length) of the completed safety belt webbing. The weft threads run transversely thereto, thus in the width extent (width) of the safety belt webbing. The thickness extent (thickness) runs perpendicularly to the width extent and the longitudinal extent of the safety belt webbing.

According to one preferred embodiment, the directly adjacent warp thread in the weave repeat is offset by at least one weft thread, preferably by exactly one weft thread (also referred to as weft). The warp threads in the weave repeat are usually numbered from left to right. In this way, the first, left warp thread in an 8-end weave repeat is numbered 1, while the right and last warp thread is numbered 8. Warp thread number 2, which is directly adjacent to number 1, is thus offset by at least one weft thread. Warp thread number 3, which is directly adjacent to warp thread number 2, in relation to warp thread number 2 is again offset by at least one weft thread.

The safety belt webbing according to the invention can be implemented by a combined twill. The latter comprises at least two twill wales in the weave repeat and has at least 6 ends, preferably 8 ends. In the case of the combined twill, the offset of mutually directly adjacent warp threads in the weave repeat would be exactly one. The combined twill here can be embodied as an even-sided or uneven-sided combined twill. The advantage of a combined twill in comparison to a 3-end simple warp twill alternating with a 3-end simple weft twill, as is described in DE 10 2011 084 336 B4 lies in that all warp threads within the weave repeat at least temporarily counteract and in this way have a hard, thread-by-thread counter-weave. The further advantage of an even-sided combined twill lies in that both sides of the fabric have the same visual appeal. A further advantage of an even-sided combined twill, for example in comparison to conventional simple twills, lies in that the number of weave points per weave repeat is increased. Overall, there is less slippage of the warp and the weft in the woven fabric. The resistance to slippage of such a woven fabric is therefore higher. The resistance to slippage here is understood to mean the force that is required to prevent the horizontal displacement of warp or weft threads from the original position thereof, thus to prevent the woven fabric becoming instable. Counter-weave presently means that in mutually adjacent warp threads, when viewed at the level of the same weft thread, the one warp thread is raised, a warp elevation thus being present, whereas the other warp thread is lowered, said warp threads thus blocking each other and not being displaced when under stress, in particular by friction and pressure.

The direction of the wale of the combined twill along the width or the length of the safety belt webbing can alternate from an S-wale to a Z-wale or vice versa. In principle, it is conceivable that the woven fabric, proceeding from the basic or initial concept of the combined twill, is rearranged by swapping the sequence of the warp threads. Different patterns and thus visually appealing forms of appearance can be implemented by these measures.

As a result of the measures according to the invention, such as the woven fabric construction and the use of an 8-end combined twill, a woven fabric which particularly well implements the advantages according to the invention can be specified.

The safety belt webbing can preferably have warp threads which have a yarn count between 550 dtex and 2500 dtex, and preferably between 800 dtex and 1200 dtex. Also, the yarn count of the warp threads can be between 280 dtex and 1400 dtex. It has been demonstrated that these are optimum parameters for an ideally high woven fabric factor.

Further measures that improve the invention will be illustrated in more detail in the figures hereunder conjointly with the description of a preferred embodiment of the invention.

DETAILED DESCRIPTION OF THE INVENTION

Figure 1A:
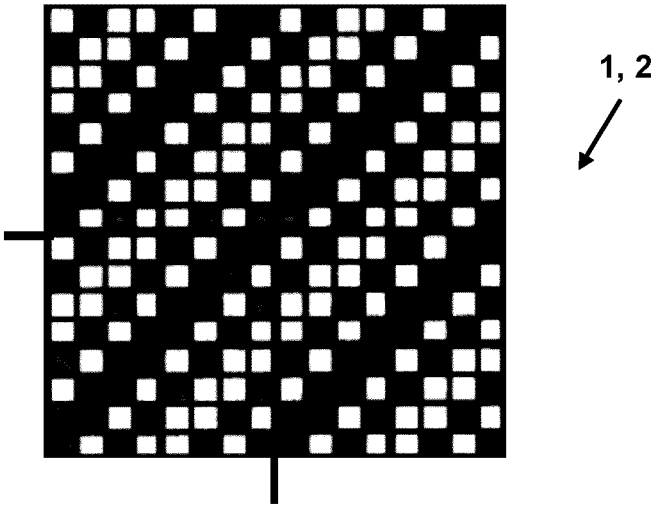
FIG. 1*a* shows a weave diagram of a first embodiment of the invention, having an 8-end even-sided combined twill.
Figure 1B:
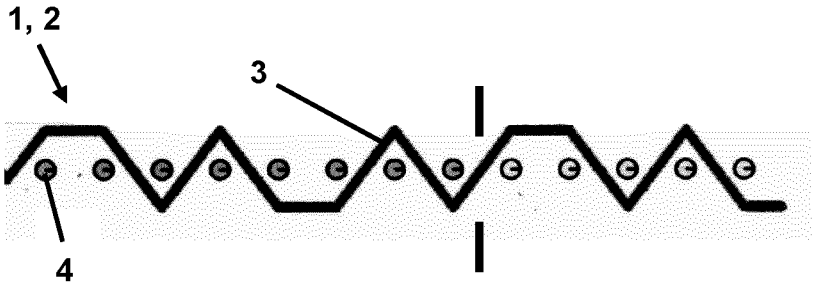
FIG. 1*b* shows the weaving mode of the first warp thread of the weave diagram from FIG. 1.
Figure 2:
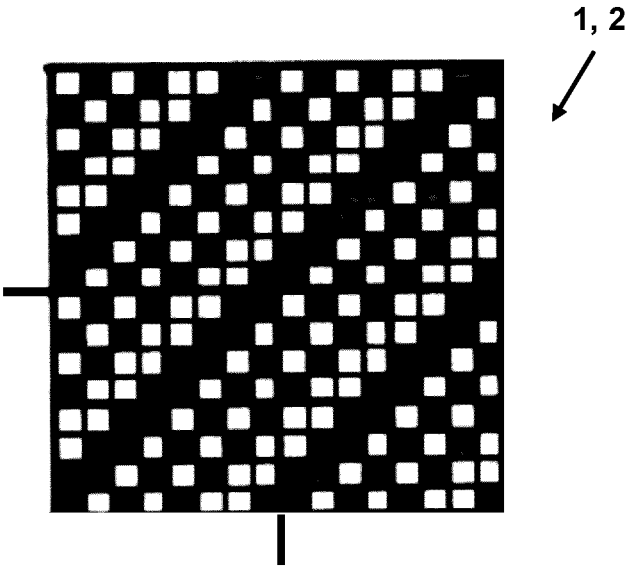
FIG. 2 shows a weave diagram of a second embodiment of the invention, having an 8-end even-sided combined twill with a changed wale sequence.
Figure 3:
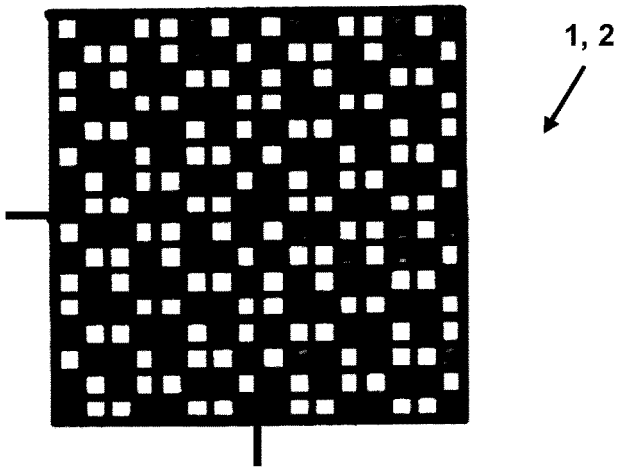
FIG. 3 shows a weave diagram of a third embodiment of the invention having an 8-end combined twill by rearranging the warp threads.

FIGS. 1 to 5, in each case in a highly schematic illustration of the respective weave diagram, show different embodiments of the woven fabric 2 of part of a safety belt webbing 1 according to the invention. A weave diagram is thus the cycle at which warp threads 3 intersect weft threads 4 so as to form the woven fabric 2. In each of the weave diagrams illustrated, the weave repeat is indicated by the lateral lines in the left lower quadrant of the weave diagrams illustrated. Said weave repeat indicates how many warp and weft threads 3, 4 are required to produce the single pattern. The warp threads 3 in FIGS. 1*a* and 2 to 5 here run perpendicularly (thus in the longitudinal extent of the safety belt webbing 1 to be produced), whereas the weft threads 4 run horizontally (thus in the width extent of the safety belt webbing 1). Each of the small squares in the weave diagram here forms one weave point between a warp thread 3 and a weft thread 4. If the square is black there is a warp elevation, the warp thread 3 thus lying above the weft thread 4. If the square is white, there is a warp depression, the warp thread 3 lying below the weft thread 4. It is a common feature of FIGS. 1*a*, 2, 4 and 5 that this is an even-sided combined twill weave. FIG. 3 is a variant of a weave of this type.

When warp threads in the figures are referenced using numbers, said warp threads are numbered from left to right, beginning with 1. Weft threads are numbered from bottom to top, beginning with 1. The point of origin for counting warp threads and weft threads is likewise formed by the first, left lower square of the weave diagram.

When viewing the weave repeat of each individual warp thread 3, proceeding from the point of origin of counting, thus from the first left lower square, here thus the warp thread number 1, the weaving mode can also be described as hereunder: first 2 warp elevations, then one warp depression, one warp elevation, two warp depressions, one warp elevation, and finally one warp depression. The following abbreviation according to DIN 61 101 results for this weave diagram of the 8-end combined twill:

$$K\frac{211}{121}Z$$

where the letter K is twill, the letter Z is the wale direction, here a Z wale. This weaving mode consequently results in an even-sided combined twill, thus two fabric sides of identical appearance of the safety belt webbing with a plurality of wales (twill wales).

This weaving mode hereunder is referred to as the basic or initial concept of the combined twill, also referred to as a combined twill weave. Twill weaves are fundamentally constructed such that the warp thread directly adjacent to the first warp thread of the weave repeat, thus warp thread number 2, is offset by exactly one weft thread. In FIG. 1*a* this can be seen in that the warp thread number 2 has an identical weaving mode as warp thread number 1, the former in relation to the latter simply being offset "in an upward manner" by one weft thread. The same also applies to the warp thread number 3; the latter in relation to the direct neighbor thereto, the warp thread number 2, is again offset "in an upward manner" by one weft thread.

The weaving mode of the warp thread number 1 from FIG. 1*a* is shown in detail in FIG. 1*b*. The weaving pattern is repeated after the eighth weft thread 4, when viewed from the left (weave repeat). It can be very clearly seen here that the warp float is exactly two, i.e. the warp thread 3 running across exactly two weft threads 4 as a warp elevation, and likewise running below exactly two weft threads 4 as a warp depression. In addition to the two floats, further individual warp elevations and warp depressions are present. In this way, exactly two warp floats and a total of four individual warp elevations and warp depressions are present per warp thread 3 in the weave repeat. When viewed in the weave repeat for each warp thread 3, this thus results in a total of six intersection points (weave points, which are created in the transition from a warp elevation to a warp depression, or vice versa) with the weft threads 4 for such an 8-end combined twill. This is a relatively high number such that the advantages according to the invention can be particularly well implemented as a result.

FIG. 2 shows a variant of the weave diagram of FIG. 1*a* according to a second embodiment of the invention. Here too, this is an 8-end combined twill, only the wale sequence (2/2:1/1) has changed here. The weaving mode can be described by the following abbreviation:

$$K\frac{211}{211}Z$$

Here too, there are again two warp floats across (exactly) two weft threads per weave repeat of one warp thread 3, and there are in total four further, individual warp elevations/depressions.

A third embodiment of the invention is illustrated in FIG. 3. Here too, this is an 8-end combined twill. The embodiment of FIG. 1*a* again forms the basis for this weaving mode. Proceeding from said embodiment of FIG. 1*a*, the warp threads 3 are rearranged. Proceeding from the warp threads numbers 1 to 8 of the weave repeat per warp thread 3 of FIG. 1*a*, the warp threads 3 are swapped among one another here such that the rearranged sequence results as shown in FIG. 3 (wherein the numbers reflect the number of the original weaving mode from FIG. 1*a*): 1-5-2-6-3-7-4-8.

Figure 4:
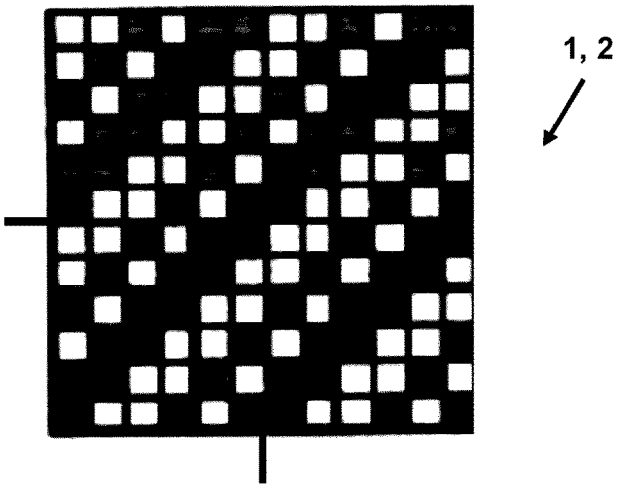
FIG. 4 shows a weave diagram of a fourth embodiment of the invention, having a 6-end combined twill.

In contrast to the preceding alternatives, the fourth embodiment according to FIG. 4 shows a 6-end combined twill. This embodiment also follows the requirement according to the invention that each individual warp thread in the weave repeat has one warp float (across or below exactly 2 weft threads) and additionally individual warp elevations and warp depressions. The weaving mode for this embodiment can be described by the following abbreviation:

$$K\frac{21}{12}Z$$

Here too, there are thus exactly two warp floats and additionally a total of two individual warp elevations/warp depressions for each individual warp thread in the weave repeat.

The woven fabric from which the safety belt webbing 1 according to the invention is at least partially produced, can be described by the respective weave diagram of FIGS. 1 to 4. Combinations of weaving modes in a single safety belt webbing, as are individually illustrated in the embodiments, are conceivable. In this instance, the woven fabric of such a safety belt webbing 1 could comprise a plurality of stripes in the width extent (in the weft thread direction) of said safety belt webbing 1, wherein the weaving modes may alternate from one stripe to another. In this way, the pattern according to a first warp repeat (6 or 8 warp threads) can vary across the width of the safety belt webbing. It is also conceivable to provide a plurality of stripes of a single weaving mode. It is also conceivable that the safety belt webbing 1 also has selvedges which according to the prior art can be configured as rib weaves, hollow weaves, twill weaves or as Rukaflex® selvedges.

Figure 5:
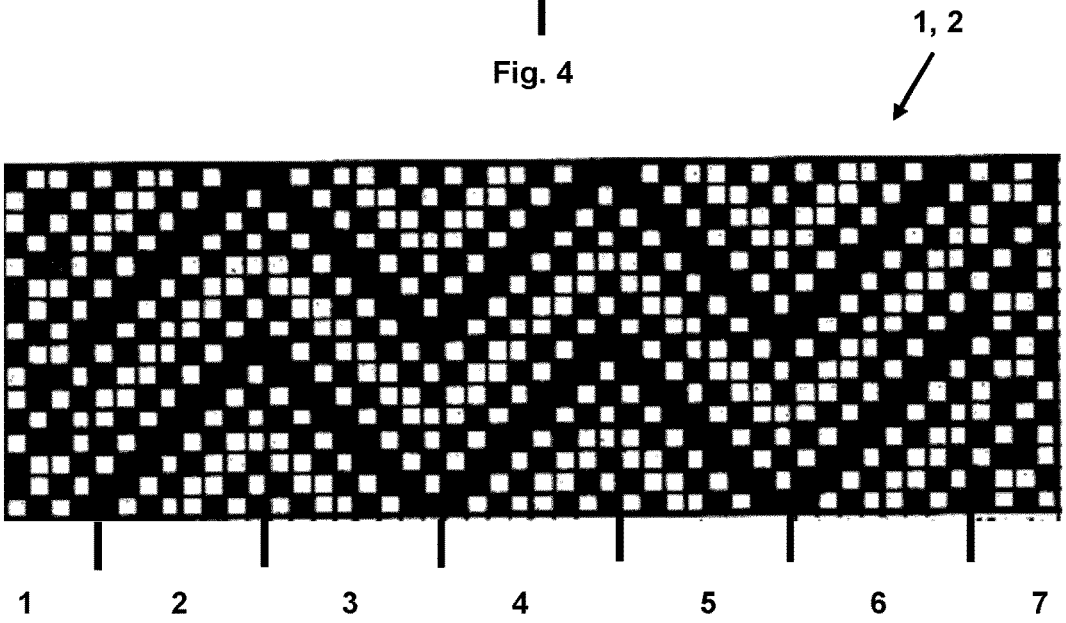
FIG. 5 shows a weave diagram of a fifth embodiment of the invention, having an 8-end combined twill with a wale changeover and with lateral selvedges.

A fifth embodiment according to FIG. 5 shows an exemplary weave diagram for a safety belt webbing 1, comprising a woven fabric from a combined twill. The woven fabric in the width is subdivided into seven individual stripes 1 to 7. The left and right stripes 1 and 7 form the selvedges of the safety belt webbing. The latter presently have four ends. This however is not mandatory. The stripes 2 to 6 presently have eight ends. The weaving mode of the stripes 2, 4 and 6 corresponds to the weaving diagram (ground weave) as per FIG. 1*a*. The latter has a Z-wale. The stripes 3 and 5 differ in accordance with the wale thereof (here: S-wale). In this way, only S-wales and Z-wales alternate across the width. Particularly appealing visual fabric appearances, patterns and forms of appearance can be achieved with such an arrangement.

Using both woven fabrics mentioned here by way of example, the mentioned advantages in terms of the required mechanical characteristics and usage properties can be particularly well achieved. This is because the combined twill weaves generally score well as a result of a comparatively high number of weave points, a very high resistance to slippage, very high stability, and additionally as a consequence of the potential, enhanced counter-weave of respective directly adjacent warp threads.

Figure 6:
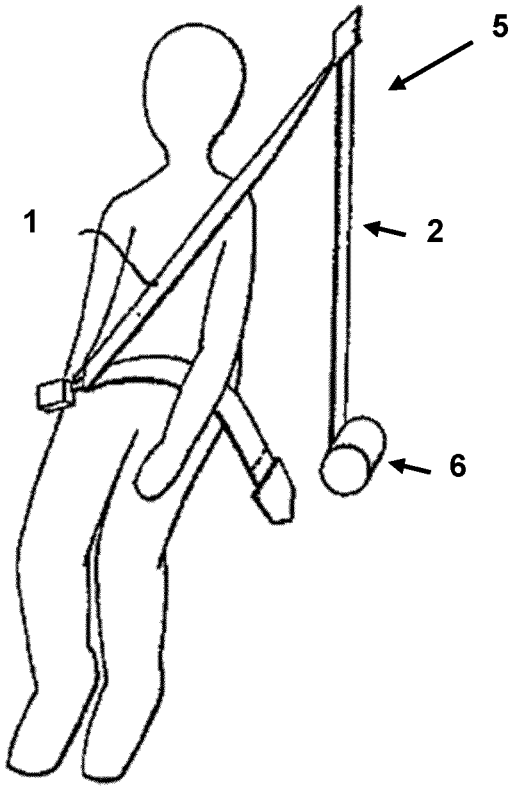
FIG. 6 shows a schematic illustration of a safety belt webbing according to the invention in a restraint system of a vehicle.

A restraint system 5 for vehicle occupants, such as the present invention also relates to, is shown in FIG. 6. This comprises a safety belt which is produced from the safety belt webbing 1 according to the invention by weaving. When not in use, thus when unfastened, the safety belt webbing 1 is (in some instances) automatically wound up in a retractor 6. As a result of the configuration of the safety belt webbing 1 according to the invention, a safety belt webbing 1 which is significantly thinner in comparison to the prior art and has substantially the same mechanical characteristics and usage properties as such a known safety belt webbing can now be specified. Less material can be used as a result of the weaving mode according to the invention, but the woven fabric nevertheless does no longer lose stability. As a result, relatively good usage properties, such as fastening and wearing of the safety belt, can be achieved for the vehicle occupants. The risk of twisting in the tongue is reduced; the safety belt webbing 1 is more insensitive in relation to rubbing as a result of extraction and retraction in the retractor 6 and on the tongues and on the deflector. Finally, a thinner safety belt webbing 1 having a comparatively long service life can be specified.

LIST OF REFERENCE SIGNS

1 Safety belt webbing
2 Woven fabric
3 Warp thread
4 Weft thread
5 Restraint system
6 Retractor

The invention claimed is:

1. A safety belt webbing for a vehicle, the safety belt webbing comprising:

a woven fabric including mutually intersecting warp threads and weft threads, said woven fabric being at least partially configured with a weave repeat having at least 6 ends;

a) a weave pattern per warp thread including at least four intersection points with said weft threads, said intersection points being weave points resulting between said warp thread and said weft threads where said warp thread within said weave repeat changes from a warp elevation to a warp depression, or from a warp depression to a warp elevation; and b) within said weave repeat, a largest warp float per warp thread being across two weft threads, and a maximum warp depression being below two weft threads; and c) within said weave repeat, per weft thread at least one warp elevation in addition to said warp float across one weft thread is present, and at least one warp depression below one weft thread is present.

2. The safety belt webbing according to claim 1, wherein said woven fabric is at least partially configured with said weave repeat having 8 ends, and said weave pattern per warp thread includes six intersection points with said weft threads.

3. The safety belt webbing according to claim 1, wherein a directly adjacent warp thread is offset by at least one weft thread.

4. The safety belt webbing according to claim 3, wherein said directly adjacent warp thread is offset by exactly one weft thread.

5. The safety belt webbing according to claim 1, wherein said woven fabric is configured as a combined twill including at least two twill wales in said weave repeat, and said combined twill has at least 6 ends.

6. The safety belt webbing according to claim 5, wherein said combined twill has 8 ends.

7. The safety belt webbing according to claim 5, wherein said combined twill is an even-sided or uneven-sided combined twill.

8. The safety belt webbing according to claim 5, wherein a wale direction of said combined twill along a width or a length of the safety belt webbing alternates from an S-wale to a Z-wale or from a Z-wale to an S-wale.

9. The safety belt webbing according to claim 5, wherein said woven fabric, proceeding from a basic concept of said combined twill, is rearranged by swapping a sequence of said warp threads.

10. The safety belt webbing according to claim 1, wherein said warp threads have a yarn count of between 550 dtex and 2500 dtex.

11. The safety belt webbing according to claim 1, wherein said warp threads have a yarn count of between 800 dtex and 1200 dtex.

12. The safety belt webbing according to claim 1, wherein said weft threads have a yarn count of between 280 dtex and 1400 dtex.

* * * * *